United States Patent [19]

Weis

[11] 4,453,464

[45] Jun. 12, 1984

[54] PRINTING PRESSES

[75] Inventor: Anton Weis, Lorsch, Fed. Rep. of Germany

[73] Assignee: Albert-Frankenthal AG, Frankenthal, Fed. Rep. of Germany

[21] Appl. No.: 440,971

[22] Filed: Nov. 12, 1982

[30] Foreign Application Priority Data

Dec. 24, 1982 [DE] Fed. Rep. of Germany ..... 8137709

[51] Int. Cl.[3] ..... B41F 9/00; B41F 13/00

[52] U.S. Cl. ..... 101/153; 101/216; 192/91 A

[58] Field of Search ..... 101/153, 152, 212, 216, 101/181, 183; 192/89 B, 91 A, 65, 77

[56] References Cited

U.S. PATENT DOCUMENTS 3,791,499 2/1974 Ryan ..... 192/89 B X
4,131,185 12/1978 Schall ..... 192/89 B X

FOREIGN PATENT DOCUMENTS 1066771 6/1954 France ..... 192/89 B
955852 4/1964 United Kingdom ..... 89/13

*Primary Examiner*—J. Reed Fisher
*Attorney, Agent, or Firm*—Collard, Roe & Galgano

[57] ABSTRACT

In a printing press such as a rotogravure press having cylinder which frequently has to be changed and which is joined up with a driving shaft by way of a clutch, more rational changing of the cylinder is made possible by designing the clutch in the form of a housing, joined with the driving shaft, and of a pin (coaxially fixed to the end of the cylinder) within the housing, that has a collet-like bush within it which takes up the pin and may be caused to undergo contraction and expansion for gripping and freeing the pin within it. To this end there is a stack of frustoconical washers placed on the bush. This stack may be acted upon by a spring unit in an axial direction while the opposite end of the stack is supported. For freeing the stack from the force of the spring unit and so letting expansion of the bush take place, the spring unit may be acted upon by a piston and pushed clear of the stack. On the opposite side of the piston there is a piston working space into which driving fluid may be run.

14 Claims, 2 Drawing Figures

PRINTING PRESSES

BACKGROUND OF THE INVENTION

The present invention is with respect to a printing presses and more specially to rotogravure or intaglio presses having at least one cylinder with a clutch for connection with a drive.

In the case of printing presses with a cylinder, as for example the intaglio cylinder of a rotogravure press, turned by way of a clutch from a drive, the connection between the cylinder and the drive has to be undone for taking the cylinder out of the press. The clutches used in the art for this purpose so far are in the form of fixed or built-in clutches, whose two halves are joined together by screws. Undoing and doing up such screws is a somewhat slow and complex operation, that is more specially troublsome if the cylinder of the press has to be frequently changed, this in fact being the case with rotogravure presses.

SHORT OUTLINE OF THE INVENTION

Starting with this stage of development of the prior art so far, one purpose of the present invention is that of designing a clutch system of the sort noted, that on the one hand puts an end to the shortcomings of a known clutch assemblies, while on the other hand makes certain that the clutch may be simply and quickly worked, that the cylinder may be rationally changed and that, furthermore, a high torque may be transmitted without any trouble conditions.

This purpose and further purposes and objects of the invention are effected in surprisingly simple way inasmuch as the the clutch has a housing drivingly joined up with the drive and a pin (that is fixed coaxially to one end of the cylinder) running into the housing where it is taken up in a bush. This bush is joined up with the housing and may undergo radial expansion and has a stack of frustoconical washers placed round it. This stack of washers has one end resting against an axial support, whereas its other end is placed so that it may be pushed against by a spring unit. A piston has a working face (turned away from the spring unit) at one end of a pressure space, that may be joined up with a source of driving fluid, whereas an opposite face of the piston is designed for acting against the spring unit and moving it clear of the stack so that expansion of the bush may then take place freeing the pin.

Putting this somewhat differently it will be seen that when the piston is acted upon by the driving fluid, it will have such an effect on the washer stack that the bush is no longer forced by it onto the pin, that is to say, the washer stack is changed over from its normal locking condition in which, acted upon by the spring unit, it keeps the bush forced radially inwards on the pin with a clutching effect, into a condition in which, after radial expansion of the bush, the pin is freed. It will be seen from this that the invention makes possible a clutch responsible for producing a driving connection between the housing and the pin and which may be simply clutched and declutched. The use of the washer or ring stack is responsible for turning the axial force into a radial force that is about five times greater, so that one has a slip-free or trouble-free torque transmission function from the housing that is joined with the drive by way of the bush that is locked on the housing, to the pin on the cylinder. For this reason it will be clear that the useful effect of the invention is the great economy produced.

As part of a useful further development of the invention, the housing may have a cover at the cylinder end thereof, the cover being able to be taken off and being joined up with the bush (placed round the pin), more specially by being formed from one piece of material therewith. Such a mechanical design is on the one hand simple and on the other hand makes certain that the bush is firmly kept in position.

Furthermore the bush may have slits running from a free end thereof to radial holes therethrough near the cover, the slits being narrower than the holes. The function of the holes is that of stopping any cracks in the bush material starting and running out from the ends of the slits. For this reason the working life of the component having the bush is made longer.

Further useful developments of the invention and details thereof will now be seen from the account, based on the figures, of one working example of the invention.

LIST OF VIEWS OF THE FIGURES

DETAILED ACCOUNT OF WORKING EXAMPLE OF THE INVENTION

Figure 1:
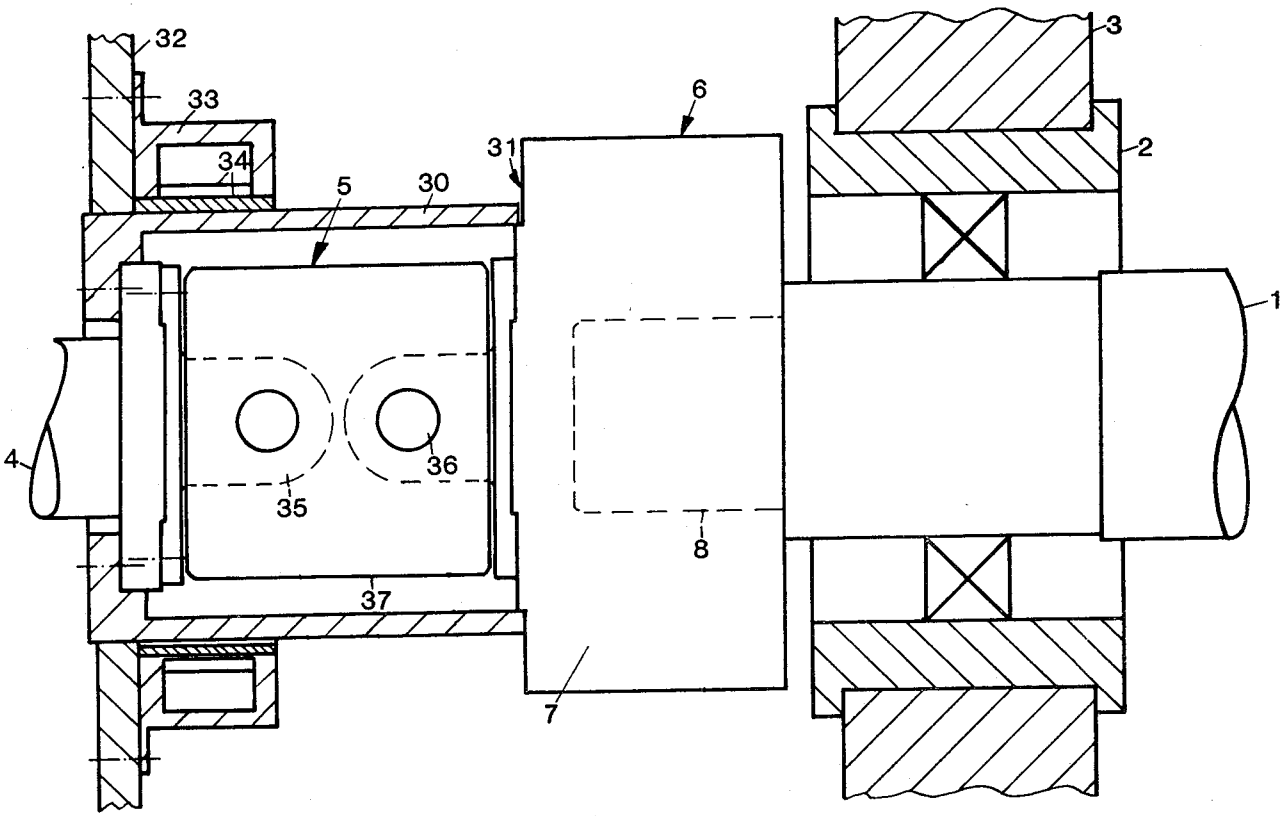
FIG. 1 is a view and part section of the intaglio cylinder of a rotogravure press a joined by a clutch with a driving shaft.

The structure and design of a rotogravure press are well known so that no general details are necessary herein. The intaglio or gravure cylinder generally numbered 1 in FIG. 1 has its trunnions or journals supported in plain bearings 2, that, together with the intaglio cylinder, may be slipped into place in openings in the side frames of the press. For driving the intaglio cylinder 1 the press has a driving shaft 4, that is joined up with the cylinder 1 by way of a joint 5 and a clutch that may be dismounted for changing cylinders.

Figure 2:
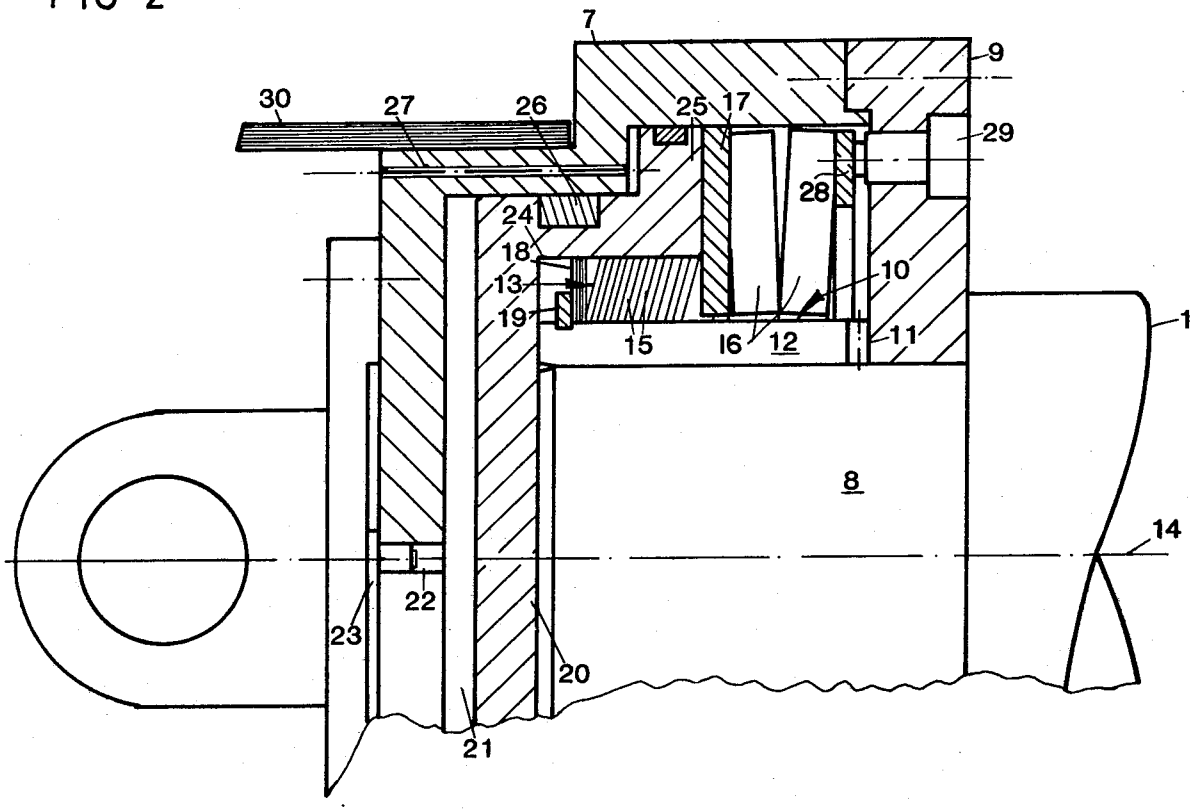
FIG. 2 is a lengthways section on a greater scale of the clutch of FIG. 1.

As may be seen from FIG. 2, the clutch 6 is made up of a bell-like housing 7 that is torque-transmittingly joined up with the driving shaft 4 and in which there is placed a pin 8. This pin is coaxially joined up with the left hand end of the intaglio cylinder. Because the pin is smaller in diameter than the cylinder 1, there is by the nature of things a shoulder, facing to the left, at the right hand end of the pin 8. In function the pin 8 and the housing 7 may be looked upon as the two halves of a clutch or coupling which may be torque-transmittingly joined together as desired. At is end nearest to the cylinder 1, the housing has a cover 9, that may be taken off and is formed in one piece with a bush 10, said bush running inwards from the cover 9 to the left into the housing. For making radial expansion and radially inward gripping of the bush or sleeve possible it has two or more slits 12 running from radial holes 11 through the wall of the bush axially to the left hand end of the bush. The holes 11 have a diameter of about 3 mm and have the function of stopping any cracks starting and running outwards from the end of the slits 12. The slits have a width of about 1 mm. The bush 10, which is formed with the cover 9 from a single piece of material, may be forced inwards by a stack 13 of washers onto the pin 8 for gripping it and transmission of driving torque thereto. The stack 13, which is slipped onto the bush 10, is made up of a number of frustoconical washers 15 or rings like belleville plate springs, that, as seen in a radial section parallel to the axis 14 of the clutch, are at a slope to radial planes normal to the axis. The washers are joined together by vulcanized rubber. An axial force acting on the stack 13 will be turned into a radially inward force with a mechanical advantage of 1 to 5.

For transmitting such an axial force to the stack 13 a belleville spring unit 16 made up of two belleville elements is used that are placed round the bush 10. Between the unit 16 and the washer stack 13 there is an axially sliding driver ring 17. The left hand end of the stack 13 stopped from moving, this being done in the present working example by having a support or stop ring 18, that for its part is kept in place and supported by a lock ring 19, that is seated in a groove in the outer face of the bush 10. The driver ring 17 and more specially the stop ring 18 may be made of hardened material so that they will not be bent or worn in use. In the present working example of the invention the washers 15 of the stack 13 are sloped outwards to the right, that is to say towards the driver ring 17. To make certain that there is no seizure of the washer stack 13 against the radially inner edge of the stop ring and for stopping any uncontrolled motion or slipping of the parts, the stop ring 18, that is made of hardened material, has sharp, unrounded edges. The washer stack 13 may be freed of the force normally acting on it by a piston 20, that is designed to be moved axially in the housing so that the spring unit 16 is pushed together in a direction opposite to the force produced by it (acting to the left) for pushing on the stack 13 so that the bush 10 is locked onto the pin 8. The working face of the piston 20 is on one side of a piston space 21, into which driving fluid may be run for moving the piston 20 in the opposite direction to the force of the unit 16. For letting in such driving fluid the wall of the housing opposite to the working face of the piston 20 has a threaded opening 22 in the middle thereof taking up a union for producing a connection with a fluid duct 23. Such supply duct 23 may be designed running through the middle part of the joint 5 and the driving shaft 4 to a rotary glanded union for producing a connection with the fluid supply line. The driving fluid for operation of the piston may be compressed air or, more specially, hydraulic liquid.

The piston 20 will be seen to be a generally bell-like structure opening to the right at 24, that is to say away from the piston space 21. The washer stack 13, the part of the bush therein and the pin 8 are placed with the bell opening 24. The end face of the piston turned away from the piston space may be moved up against the driver ring 17. The diameter of the spring unit 16 is very much greater than the diameter of the washer stack 13. This is true as well with respect to the driver ring 17. The piston 20 has an edge lip 25 so that it is matched in diameter with the driver ring 17, the inner face of the housing 7 being stepped for matching the two different diameters of the piston 20. One or more sealing rings 26 may be seated within grooves in the outer radial face of the piston 20. For letting off air, and for letting in air, from and into the space walled in between the steps of the piston and the cylinder's inner face, there is an air let-off opening 27. Adjustment of the acting force of the spring unit is possible using an adjustment part, that has an adjustment ring 28 that is supported on adjustment screws 29. These screws are taken up in threaded holes in the cover 9 of the housing. This system makes it possible for the washer stack 13 and the spring unit to be taken out and put in place in a force-free condition.

The position of the piston 20 to be seen in FIG. 2 is such that the spring unit 16 is pushed together and the stack 13 of washers is freed of force. Furthermore in this condition the bush 10 is unjoined from the pin 8 so that when taking the cylinder 1 from the press, the pin 8 may be pulled out of the housing 7, the motion of the piston 20 to the right being limited, when this is done, by running up against the left hand end of the bush 10. For centering the housing 7, that is joined up by joint 5 with the driving shaft 4, at the time when the pin 8 has been pulled out of the housing, there is, as may be best seen from FIG. 1, a support sleeve 30 joined up with the driving shaft 4. This support sleeve 30 is used with a shoulder 31 which has been produced by turning the left hand end of the housing 6 on a lathe, such shoulder 31 fitting into the sleeve 30. In the present working example of the invention, the sleeve has the further function of a brake drum for slowing down the intaglio cylinder 1. Further parts of this braking system are a round casing 33 fixed to the gear box 32 of the press and brake jaws 34 which are worked by a fluid, more specially compressed air. For the transmission of torque from the driving shaft 4 to the housing 7 there are eyepieces 35, each having a turnpin 36 for connection with a corepiece 37 of H-like cross-section. This form of joint makes it possible to take care of conditions in which the shaft 4 is out of line with the intaglio cylinder.

I claim:

1. In a printing press having a cylinder that is to be frequently changed, a driving shaft and a clutch for connection of said shaft with said cylinder, the invention residing in that said clutch is made up of a housing torque transmittingly joined to said shaft, a pin at one end of said cylinder, said pin being taken up within said housing, a bush within said housing, said bush being placed round said pin and being able to undergo generally radial expansion and contraction onto said pin, a stack placed round said bush, said stack being made up of frustoconical washers and having one end thereof supported axially of the pin, a spring unit for acting on an opposite end of the stack and causing said frustoconical washers to be become flatter and be responsible for an inwardly directed pushing force for causing contraction of said bush onto said pin, a piston for acting against and overriding said spring unit and decreasing the force acting on the stack, produced by said spring unit, said piston walling in a piston driving space for piston driving fluid.

2. The structure as claimed in claim 1 further having, as a part of said housing, a cover to which said bush is joined, said cover being able to be taken off said housing.

3. The structure as claimed in claim 2 wherein said cover and said bush are formed from a single piece of material.

4. The structure as claimed in claim 2 wherein said bush has slits running therealong from holes therein, said holes being larger in diameter than the slits are wide and being next to said cover.

5. The structure as claimed in claim 1 having at an end of said stack opposite to the spring unit a support ring which is made of hardened material, is placed on the bush and has a sharp, unrounded edge.

6. The structure as claimed in claim 1 wherein the piston is bell-like in form and has the washer stack, the end of the bush within the stack and the pin within it.

7. The structure as claimed in claim 1 having a drive ring, wherein the spring unit is made up of at least one belleville plate spring having a greater diameter than the washer stack, said spring unit resting on one side thereof against the drive ring, said drive ring being placed with one side thereof facing the one end of the stack and an end of the piston.

8. The structure as claimed in claim 7 wherein said piston has an outwardly turned lip, said housing having two inwardly facing surfaces forming a step with said lip and a further part of said piston of smaller diameter running thereon, said piston lip resting against said drive ring.

9. The structure as claimed in claim 1 having an adjustment unit for forcing the spring unit towards the stack.

10. The structure as claimed in claim 9 wherein said spring unit is made up of at least one belleville plate spring, said structure further having screws for adjustment of the piston of the spring unit, said adjustment unit further having an adjustment ring acted upon by said screws.

11. The structure as claimed in claim 1 wherein said piston driving fluid space is joined up fluidwise by way of a duct that is on an axis of turning of said housing and is taken through a wall of said piston space.

12. The structure as claimed in claim 1 having a joint forming a connection between the driving shaft and the housing, said joint being designed to take care of any out of line condition between the shaft and the cylinder.

13. The structure as claimed in claim 1 comprising a brake for slowing down said cylinder.

14. The structure as claimed in claim 13 having a sleeve, a shaft joint between said driving shaft and said cylinder, said sleeve being designed for use as a brake drum as part of said brake and taking up an end part of said housing within it for centering said housing.

* * * * *